US010135199B1

(12) United States Patent
Ju

(10) Patent No.: US 10,135,199 B1
(45) Date of Patent: Nov. 20, 2018

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/869,601

(22) Filed: Jan. 12, 2018

(30) Foreign Application Priority Data

May 9, 2017 (CN) ..... 2017 2 0504992 U
May 12, 2017 (CN) ..... 2017 2 0525802 U

(51) Int. Cl.

| | |
|---|---|
| ***H01R 13/648*** | (2006.01) |
| ***H01R 13/6597*** | (2011.01) |
| ***H01R 12/70*** | (2011.01) |
| ***H01R 13/6581*** | (2011.01) |
| ***H01R 13/24*** | (2006.01) |
| ***H01R 12/71*** | (2011.01) |

(52) U.S. Cl.
CPC ..... *H01R 13/6597* (2013.01); *H01R 12/7076* (2013.01); *H01R 12/714* (2013.01); *H01R 13/2435* (2013.01); *H01R 13/6581* (2013.01)

(58) Field of Classification Search
CPC ..... H01R 13/6597; H01R 13/2442; H01R 13/2492; H01R 13/2408; H01R 12/714; H01R 13/2435; H01R 12/62; H01R 12/7076; H01R 13/6581
USPC ..... 439/386
See application file for complete search history.

(56) References Cited

U.S. PATENT DOCUMENTS

| | | | | |
|---|---|---|---|---|
| 7,114,959 | B2 | 10/2006 | Stone et al. | |
| 7,357,665 | B1 * | 4/2008 | Yan | H01R 13/2442 439/500 |
| 8,523,618 | B2 * | 9/2013 | Ju | H01R 24/542 439/816 |
| 9,502,844 | B2 * | 11/2016 | Chen | H01R 13/2428 |
| 9,543,722 | B2 * | 1/2017 | Kato | H01R 31/06 |
| 9,774,114 | B1 * | 9/2017 | Clements | H01R 12/62 |
| 9,871,314 | B2 * | 1/2018 | Wang | H01R 13/2492 |

(Continued)

FOREIGN PATENT DOCUMENTS

| | | |
|---|---|---|
| CN | 201994452 U | 9/2011 |
| CN | 202034567 U | 11/2011 |
| CN | 202067919 U | 12/2011 |

(Continued)

*Primary Examiner* — Jean F Duverne
(74) *Attorney, Agent, or Firm* — Locke Lord LLP; Tim Tingkang Xia, Esq.

(57) ABSTRACT

An electrical connector includes an insulating body provided with multiple accommodating holes penetrating through the insulating body vertically, multiple terminals used for contacting a chip module, and at least one shielding sheet accommodated in the insulating body. The accommodating holes include signal accommodating holes and ground accommodating holes. Each signal accommodating hole is provided with a stopping portion. The terminals include signal terminals accommodated in the signal accommodating holes and ground terminals accommodated in the ground accommodating holes. Each shielding sheet or each terminal is provided with an urging portion. The ground terminals and the shielding sheet contact each other through the urging portion, and the stopping portions stop the urging portion to prevent the signal terminals and the shielding sheet from contacting each other.

20 Claims, 11 Drawing Sheets

(56) References Cited

U.S. PATENT DOCUMENTS

2002/0048999 A1* 4/2002 Ming-Hui ..... H01R 13/2442
439/660

FOREIGN PATENT DOCUMENTS

| | | | |
|---|---|---|---|
| CN | 203326287 | U | 12/2013 |
| CN | 103579826 | A | 2/2014 |
| CN | 105244654 | A | 1/2016 |
| CN | 204947248 | U | 1/2016 |

* cited by examiner

100

100

100

A–A

100

100

ELECTRICAL CONNECTOR

CROSS-REFERENCE TO RELATED APPLICATION

This non-provisional application claims priority to and the benefit of, pursuant to 35 U.S.C. § 119(a), Patent Application Serial No. 201720504992.0 filed in P.R. China on May 9, 2017, and Patent Application Serial No. CN201720525802.3 filed in P.R. China on May 12, 2017. The entire contents of the above-identified applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE INVENTION

The present invention relates to an electrical connector, and more particularly to an electrical connector capable of preventing an electromagnetic interference between signal terminals.

BACKGROUND OF THE INVENTION

Disclosed in a Chinese patent with the patent number of CN201020663926.6 is an electrical connector, including an insulating body, multiple signal terminals, a grounding member and multiple shielding sheets. Multiple accommodating tubes are provided on the insulating body, each signal terminal is correspondingly accommodated in one accommodating tube, the multiple shielding sheets are assembled in the insulating body in a stacking manner, multiple shielding holes are provided on each shielding sheet, each shielding hole correspondingly surrounds the periphery of one accommodating tube, a notch slot is provided on the accommodating tube where the grounding member is located, and the grounding member has an extending portion extending out of the notch slot, such that the edge of the extending portion is electrically connected to the edge of the shielding sheet, thus achieving a shielding effect between each two adjacent ones of the signal terminals, and preventing from an interference during signal transmission.

However, in order to avoid short circuiting when the signal terminals urge against the shielding sheets, each signal terminal is not provided with the extending portion urging against the shielding sheet, such that the signal terminals and the grounding members are different in structure, thereby increasing the processing difficulty of the signal terminals and the grounding members during practical production. Moreover, during assembly, an operator may easily mistakenly assemble the signal terminals into the accommodating tubes where the grounding members should be located, such that the signal terminals do not urge against the shielding sheets, thus affecting the shielding effect of the electrical connector, and reducing the anti-interference capability during signal transmission.

Therefore, a heretofore unaddressed need to design a novel electrical connector exists in the art to address the aforementioned deficiencies and inadequacies.

SUMMARY OF THE INVENTION

An objective of the present invention is to provide an electrical connector, which is capable of preventing an electromagnetic interference between signal terminals.

To achieve the foregoing objective, one aspect of the invention provides an electrical connector, which includes: an insulating body, provided with a plurality of accommodating holes penetrating through the insulating body vertically, the accommodating holes comprising signal accommodating holes and ground accommodating holes, wherein each of the signal accommodating holes is provided with a stopping portion; a plurality of terminals, configured for contacting a chip module, and comprising signal terminals accommodated in the signal accommodating holes and ground terminals accommodated in the ground accommodating holes; and at least one shielding sheet, accommodated in the insulating body; wherein the at least one shielding sheet or each of the terminals is provided with an urging portion, the ground terminals and the at least one shielding sheet contact each other through the urging portions, and the stopping portions stop the urging portions to prevent the signal terminals and the at least one shielding sheet from contacting each other.

In certain embodiments, each of the signal terminals and each of the ground terminals are of a same structure and respectively provided with a connecting portion in a planar shape, and an upper elastic arm formed by bending and extending upward from the connecting portion, configured for conductively connected to the chip module.

In certain embodiments, a plurality of urging portions are provided, and the urging portions are only provided on the at least one shielding sheet.

In certain embodiments, the stopping portion of each of the signal accommodating holes is located between a corresponding one of the urging portions and the upper elastic arm of a corresponding one of the signal terminals, and the urging portion corresponding to each of the ground accommodating holes urges against the upper elastic arm of a corresponding one of the ground terminals.

In certain embodiments, a lower elastic arm is formed by bending and extending downward from the connecting portion, configured for conductively connected downward to a circuit board; the stopping portion of each of the signal accommodating holes is located between a corresponding one of the urging portions and the lower elastic arm of a corresponding one of the signal terminals, and the urging portion corresponding to each of the ground accommodating holes urges against the lower elastic arm of the ground terminals.

In certain embodiments, each of the signal terminals is farther away from the urging portions than each of the ground terminals.

In certain embodiments, each of the signal accommodating holes is farther away from the urging portions than each of the ground accommodating holes.

In certain embodiments, each of the signal accommodating holes and each of the ground accommodating holes are respectively provided with at least one position limiting portion located between the shielding sheets and the upper elastic arm.

In certain embodiments, the shielding sheet has a flat portion located at one side of an edge of the connecting portion, each of the urging portions is formed by bending and extending from the flat portion, and a plate surface of each of the urging portions urges against an edge of a corresponding one of the ground terminals.

In certain embodiments, the upper elastic arm bends and extends from a top end of the connecting portion to one side of the flat portion, and then bends and extends to an opposite side of the flat portion.

In certain embodiments, a retaining portion is formed by extending from a side of the connecting portion opposite to the shielding sheet to be retained to the insulating body.

In certain embodiments, the retaining portion is parallel to a plate surface of the flat portion.

In certain embodiments, the electrical connector further includes a metal sheet having a planar base located below the flat portion, wherein a bottom end of the flat portion contacts a top end of the base.

In certain embodiments, a plurality of openings are concavely provided at the bottom end of the flat portion, an extending portion is formed by extending upward from the top end of the base to be accommodated in one of the openings, and a contact portion is formed by bending and extending upward from the extending portion to urge against a plate surface of the corresponding shielding sheet.

In certain embodiments, each of the urging portions is formed by bending and extending downward from one of the openings, and the contact portion urges against the plate surface of a corresponding one of the urging portions.

In certain embodiments, a protruding portion is protrudingly provided on a plate surface of the contact portion to urge against the plate surface of a corresponding one of the urging portions.

In certain embodiments, a notch is concavely provided at a top end of the flat portion, each of the urging portions is formed by bending and extending upward from the notch, and the plate surface of each of the urging portions urges against an edge of the upper elastic arm of a corresponding one of the ground terminals.

In certain embodiments, each of the urging portions has a connecting section formed by bending and extending from the notch toward the edge of the upper elastic arm, and an urging section formed by vertically extending upward from the connecting section, wherein a free end is formed by bending and extending from the urging section to be away from the edge of the upper elastic arm, and a plate surface of the urging section urges against the edge of the upper elastic arm.

In certain embodiments, the at least one shielding sheet corresponds to a row of the terminals, the insulating body is provided with an accommodating groove for accommodating the at least one shielding sheet, and the accommodating groove is communicated with the signal accommodating holes and the ground accommodating holes.

In certain embodiments, the shielding sheet is provided with a plurality of through slots, the insulating body is provided with a plurality of positioning portions accommodated in the through slots respectively, a partitioning wall is provided between each of two adjacent ones of the accommodating holes, and the partitioning wall and the positioning portions are arranged abreast.

Compared with the related art, certain embodiments of the invention have the following beneficial advantages. Each shielding sheet or each terminal is provided with an urging portion, thus ensuring the ground terminals to urge against the shielding sheets, and achieving a shielding effect between the signal terminals. The stopping portions stop the urging portions, thus avoiding the shielding sheets from contacting with the signal terminals, and preventing short circuiting of the signal terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
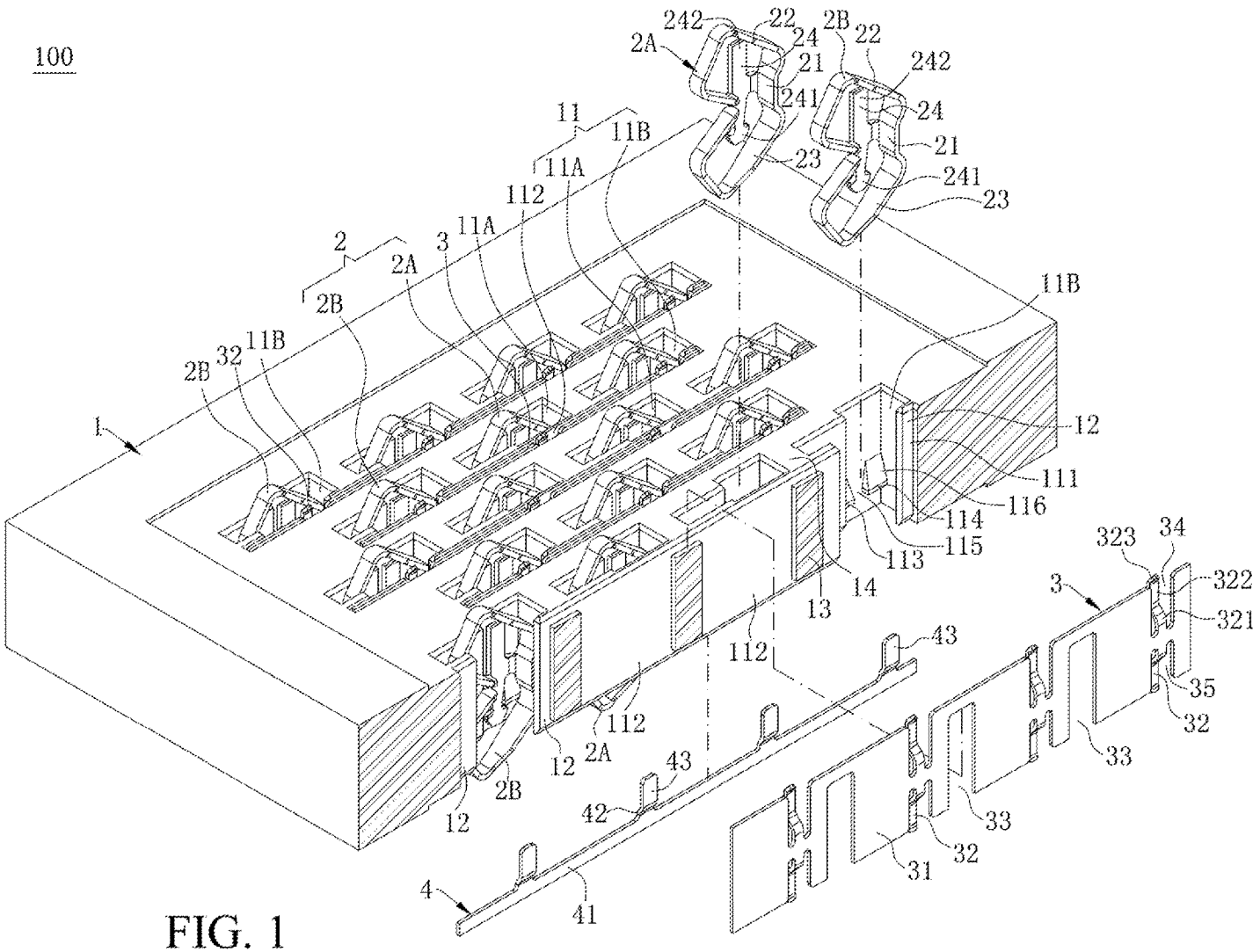
FIG. 1 is a three-dimensional exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

As shown in FIG. 1 to FIG. 4, an electrical connector according to certain embodiments of the present invention includes: an insulating body 1, provided with multiple accommodating holes 11 that penetrate through the insulating body 1 vertically, the multiple accommodating holes 11 including multiple signal accommodating holes 11A and multiple ground accommodating holes 11B, and each signal accommodating hole 11A being provided with a stopping portion 112; multiple terminals 2, including multiple signal terminals 2A accommodated in the signal accommodating holes 11A and multiple ground terminals 2B accommodated in the ground accommodating holes 11B, and used for contacting a chip module 5 to a circuit board 6; and multiple shielding sheets 3 (in other embodiments, the number of the shielding sheet is one, such as a continuous material tape in a grid shape), accommodated in the insulating body 1. Each of the shielding sheets 3 is provided with an urging portion 32. The ground terminals 2B and the corresponding shielding sheets 3 contact each other through the urging portions 32, and the stopping portions 112 stop the urging portions 32 to prevent the signal terminals 2A and the shielding sheets 3 from contacting each other.

In other embodiments, the urging portions 32 may be provided on the terminals 2. Alternatively, the shielding sheets 3 and the terminals 2 are provided with the urging portions 32 respectively. As shown in FIG. 1 to FIG. 4, the shielding sheets 3 are correspondingly accommodated in the insulating body 1 respectively in an assembling manner. Each shielding sheet 3 has a flat portion 31 located at one side of the edge of a connecting portion 21, and each shielding sheet 3 corresponds to a row of the terminals 2. Each urging portion 32 is formed by bending and extending from the flat portion 31, and a plate surface of the urging portion 32 urges against the edge of the corresponding ground terminal 2B. The insulating body 1 is provided with an accommodating groove 12 for accommodating the shielding sheets 3, and the accommodating groove 12 is communicated with the signal accommodating holes 11A and the ground accommodating holes 11B. Each shielding sheet 3 is provided with multiple through slots 33, and the insulating body 1 is provided with multiple positioning portions 13 accommodated in the through slots 33 respectively. A partitioning wall 14 is provided between each of two adjacent ones of the accommodating holes 11, and the partitioning wall 14 and the positioning portions 13 are arranged abreast.

Figure 5:
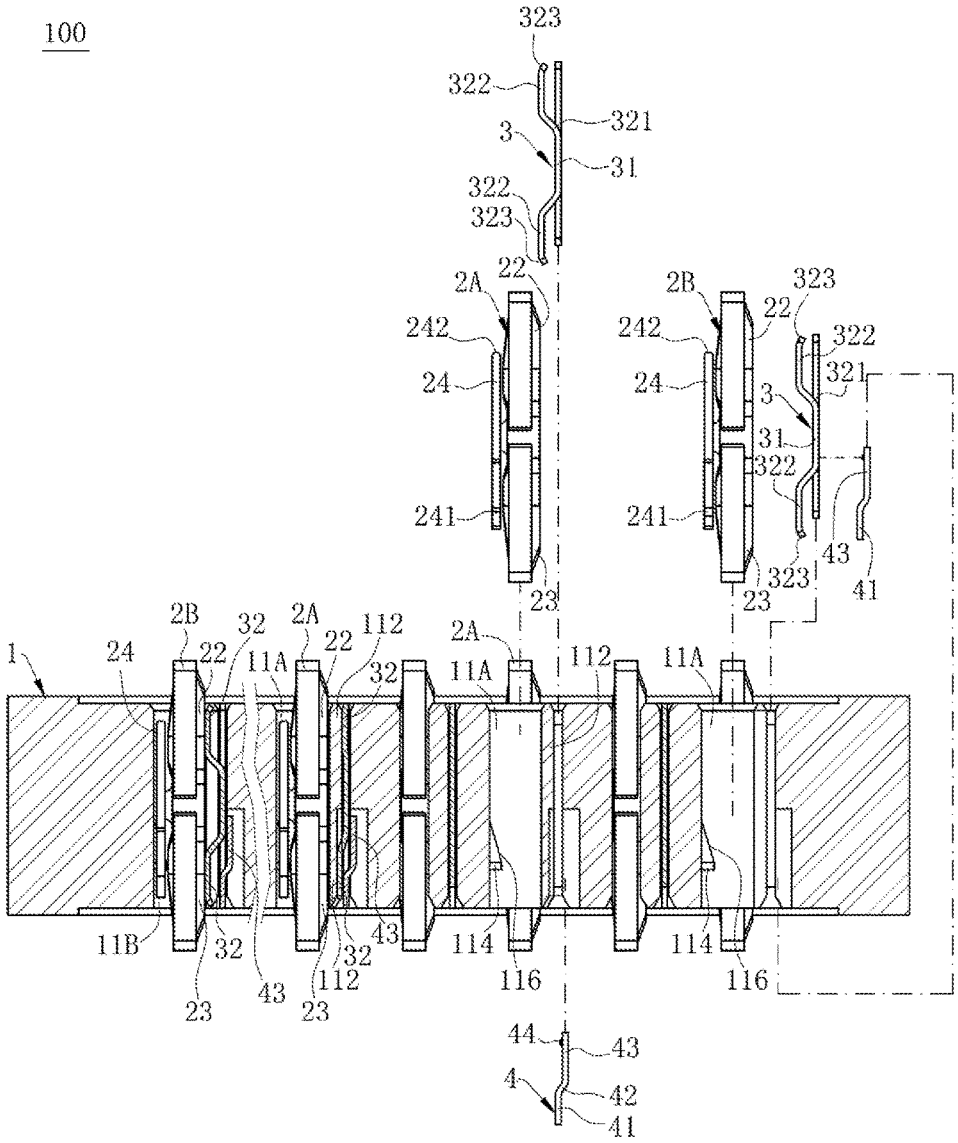
FIG. 5 is a section view in a direction A-A of FIG. 4.

As shown in FIG. 1, each of the signal terminals 2A and each of the ground terminals 2B are of the same structure, and respectively have a connecting portion 21 in a planar shape. An upper elastic arm 22 is formed by bending and extending upward from the connecting portion 21. The upper elastic arm 22 bends and extends from a top end of the connecting portion 21 to one side of the flat portion 31, and then bends and extends to the opposite side of the flat portion 31, and is used for conductively connected to the chip module 5, thus enhancing the elasticity of the upper elastic arm 22, and ensuring a stable conduction between the upper elastic arm 22 and the chip module 5. A lower elastic arm 23 is formed by bending and extending downward from the connecting portion 21. The lower elastic arm 23 bends and extends from a bottom end of the connecting portion 21 to one side of the shielding sheet 3, and then bends and extends to the opposite side of the shielding sheet 3, and is used for conductively connected downward to the circuit board 6, thus enhancing the elasticity of the lower elastic arm 23, and ensuring a stable conduction between the lower elastic arm 23 and the circuit board 6. As shown in FIG. 1 and FIG. 5, a retaining portion 24 is formed by extending from a side of the connecting portion 21 opposite to the shielding sheet 3 to be retained to the insulating body 1, and the retaining portion 24 is parallel to a plate surface of the flat portion 31, such that the signal terminal 2A and the ground terminal 2B are compact in structure, thus reducing a space being occupied.

Figure 6:
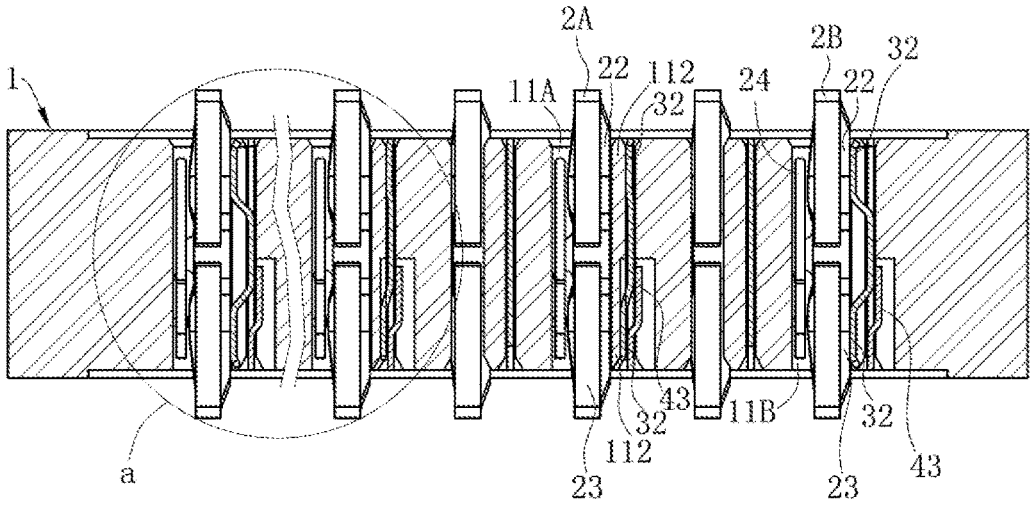
FIG. 6 is an assembled section view of FIG. 5.
Figure 7:
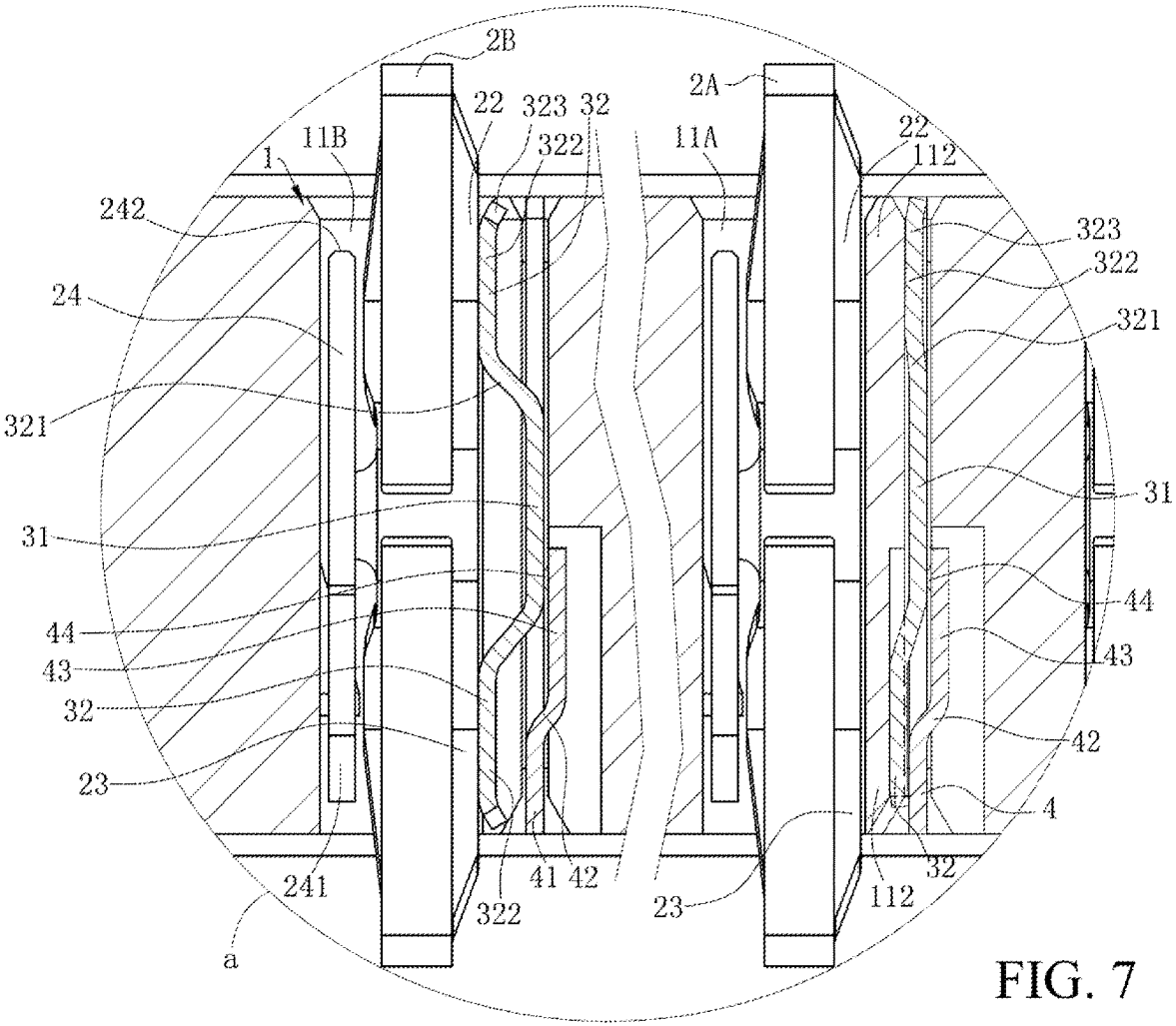
FIG. 7 is an enlarged view of a part a in FIG. 6.
Figure 8:
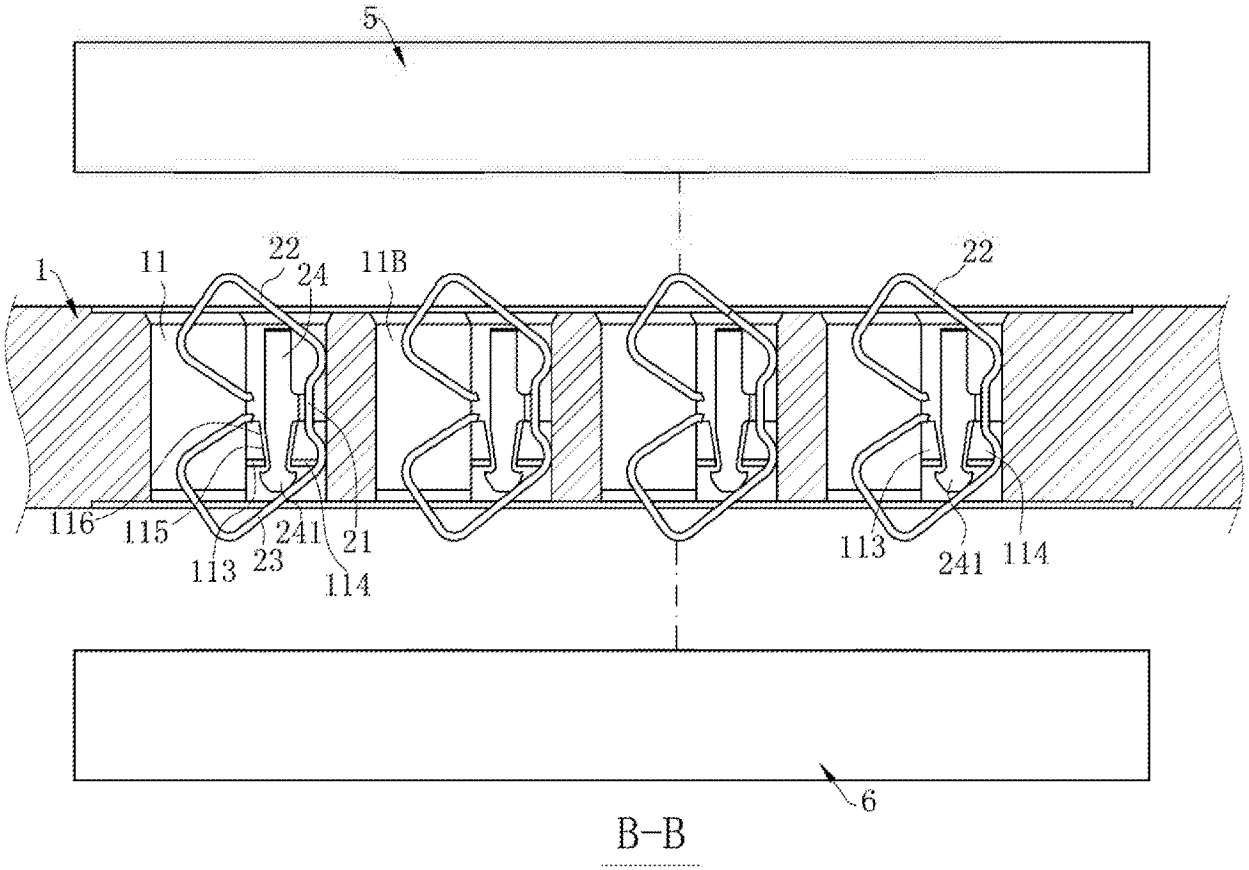
FIG. 8 is a section view in a direction B-B of FIG. 4.
Figure 9:
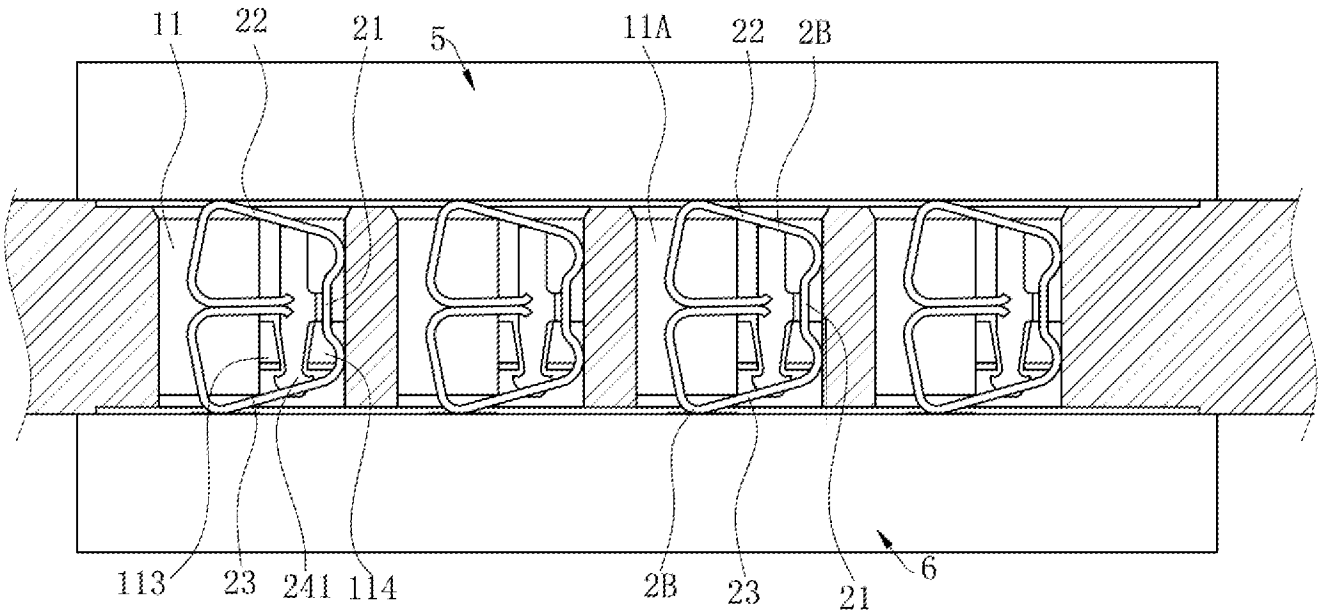
FIG. 9 is a section view of a chip module after being pressed down in FIG. 8.

As shown in FIG. 5 to FIG. 7, the stopping portion 112 of each of the signal accommodating holes 11A is located between a corresponding urging portion 32 and the upper elastic arm 22 and the lower elastic arm 23 of a corresponding signal terminal 2A, and the urging portion 32 corresponding to each of the ground accommodating holes 11B urges against the upper elastic arm 22 and the lower elastic arm 23 of the corresponding ground terminal 2B. As shown in FIG. 8 and FIG. 9, when the chip module 5 presses downward onto the upper elastic arm 22, the upper elastic arm 22 urges against the lower elastic arm 23, so as to form a first conductive path passing through the chip module 5, the upper elastic arm 22, the connecting portion 21, the lower elastic arm 23 and the circuit board 6 in sequence, and a second conductive path passing through the chip module 5, the upper elastic arm 22, the lower elastic arm 23 and the circuit board 6 in sequence. Due to a parallel connection between the first conductive path and the second conductive path, the total impedance value is reduced, and the signal transmission performance is improved.

As shown in FIG. 1 to FIG. 4, each of the signal accommodating holes 11A and each of the ground accommodating holes 11B are respectively provided with at least one position limiting portion 111 located between the shielding sheets 3 and the upper elastic arm 22. The position limiting portions 111 are used for positioning the shielding sheets 3 into the signal accommodating holes 11A and the ground accommodating holes 11B, thus avoiding the upper elastic arms 22 from urging against the shielding sheets 3. A notch 34 is concavely provided at a top end of the flat portion 31. Each urging portion 32 is formed by bending and extending up from the notch 34, and the plate surface of each urging portion 32 urges against the edge of the upper elastic arm 22 of the corresponding ground terminal 2B. As shown in FIG. 5, each urging portion 32 has a connecting section 321 formed by bending and extending from the notch 34 toward the edge of the upper elastic arm 22, and an urging section 322 formed by vertically extending upward from the connecting section 321. A free end 323 is formed by bending and extending from the urging section 322 to be away from the edge of the upper elastic arm 22, and a plate surface of the urging section 322 urges against the edge of the upper elastic arm 22.

Figure 2:
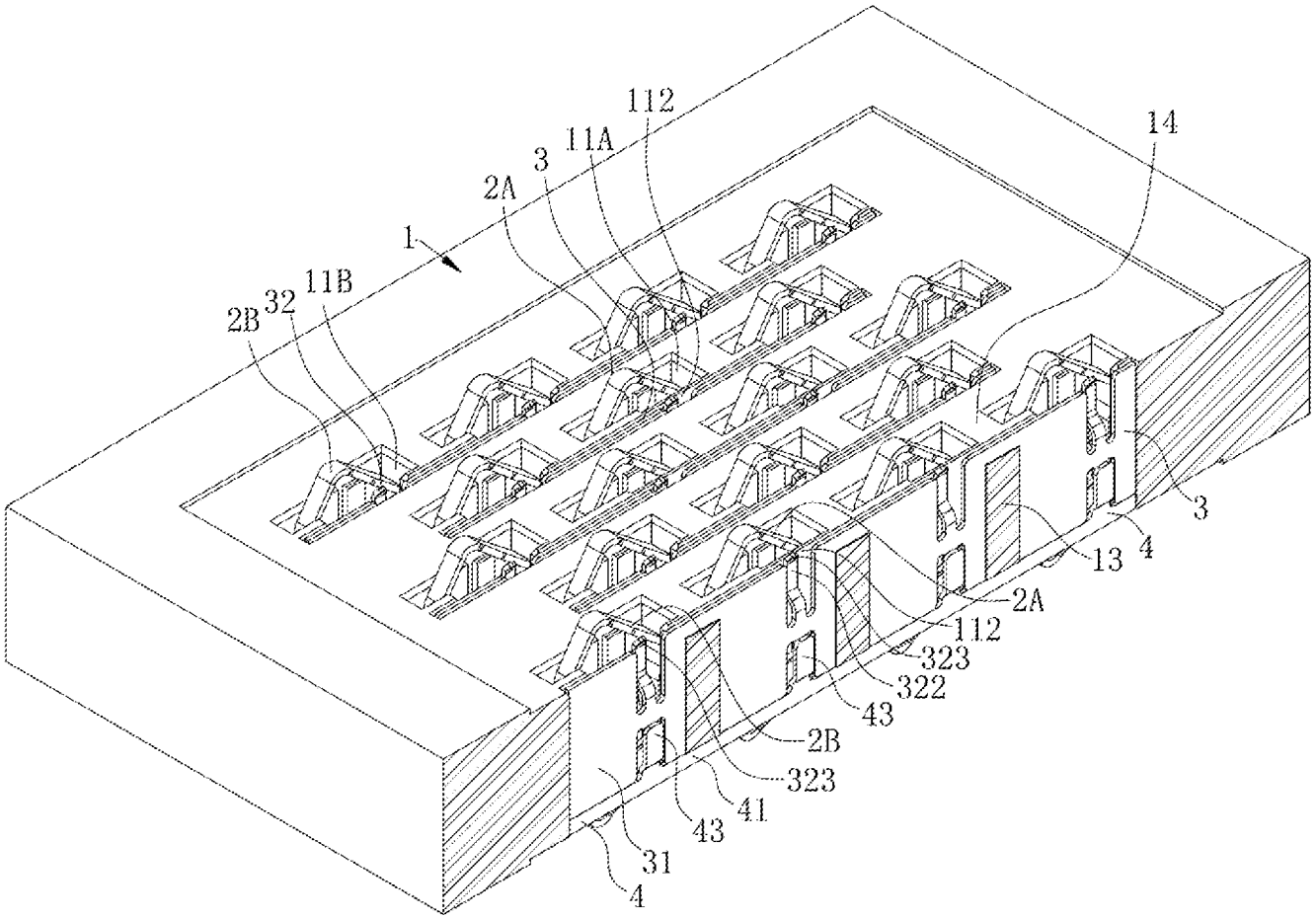
FIG. 2 is a three-dimensional assembled view of FIG. 1.
Figure 3:
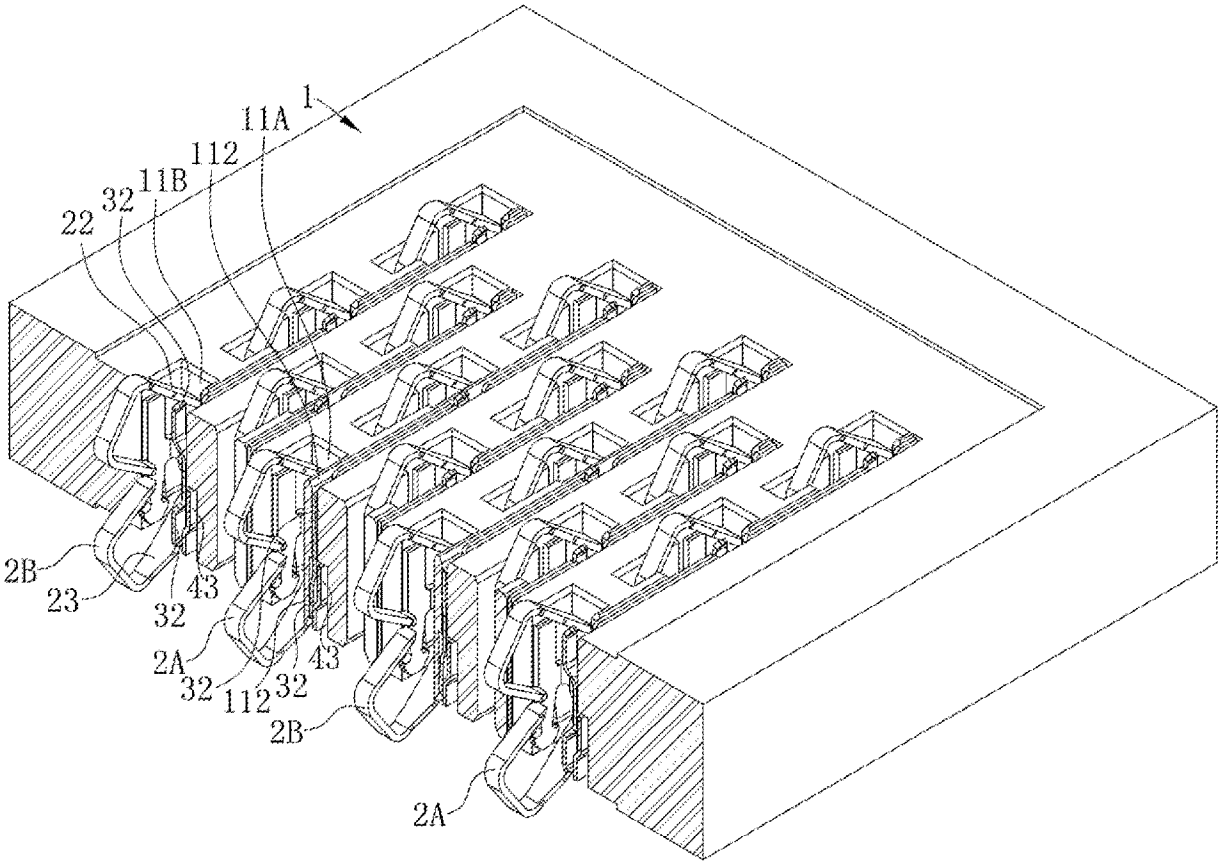
FIG. 3 is a three-dimensional assembled view of FIG. 1 from another angle.
Figure 4:
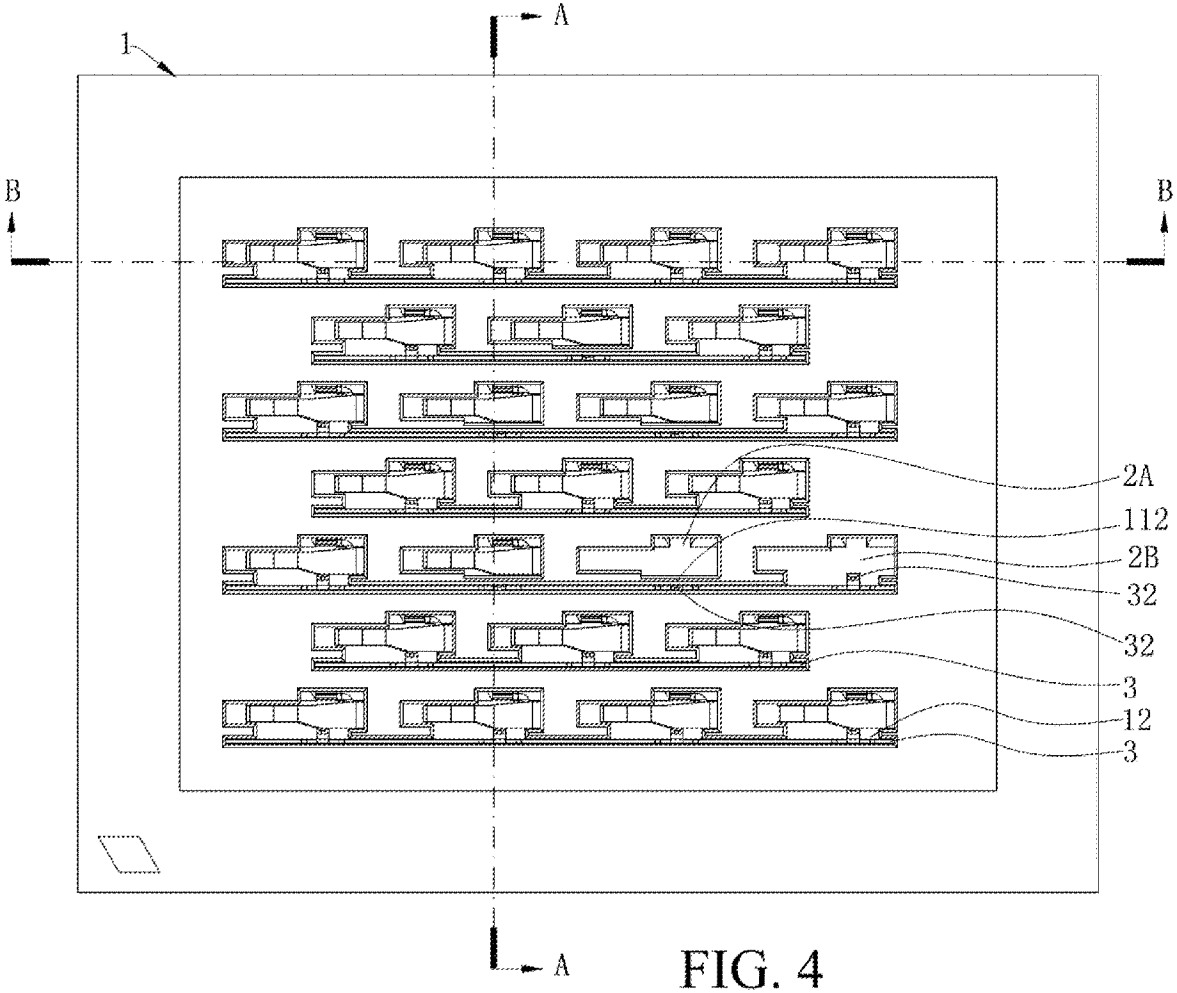
FIG. 4 is a top view of FIG. 1.

As shown in FIG. 1 and FIG. 2, the electrical connector 100 further includes a metal sheet 4, which has a planar base 41 located below the flat portion 31, and a bottom end of the flat portion 31 contacts a top end of the base 41. Multiple openings 35 are concavely provided at the bottom end of the flat portion 31. An extending portion 42 is formed by extending upward from the top end of the base 41 to be accommodated in one of the openings 35, and a contact portion 43 is formed by bending and extending upward from the extending portion 42 to urge against a plate surface of the corresponding shielding sheet 3. As shown in FIG. 5 to FIG. 7, each urging portion 32 is formed by bending and extending down from one of the openings 35, and the contact portion 43 urges against the plate surface of the corresponding urging portion 32. A protruding portion 44 is protrudingly provided on the plate surface of the contact portion 43 to urge against the plate surface of the corresponding urging portion 32.

As shown in FIG. 1 and FIG. 8, two hook portions 241 are formed at two opposite sides of a bottom portion of the retaining portion 24. A first engagement block 113 and a second engagement block 114 protrude from a side surface of the accommodating hole 11, and a channel 115 is formed between the first engagement block 113 and the second engagement block 114 for accommodating the retaining portion 24. A slope 116 is provided on a side of each of the first engagement block 113 and the second engagement block 114 adjacent to the channel 115. The slopes 116 are used for guiding the hook portions 241 to enter and be located below the first engagement block 113 and the second engagement block 114. A strip connecting portion 242 is provided at a top end of the retaining portion 24 and is used for connecting a strip.

Figure 10:
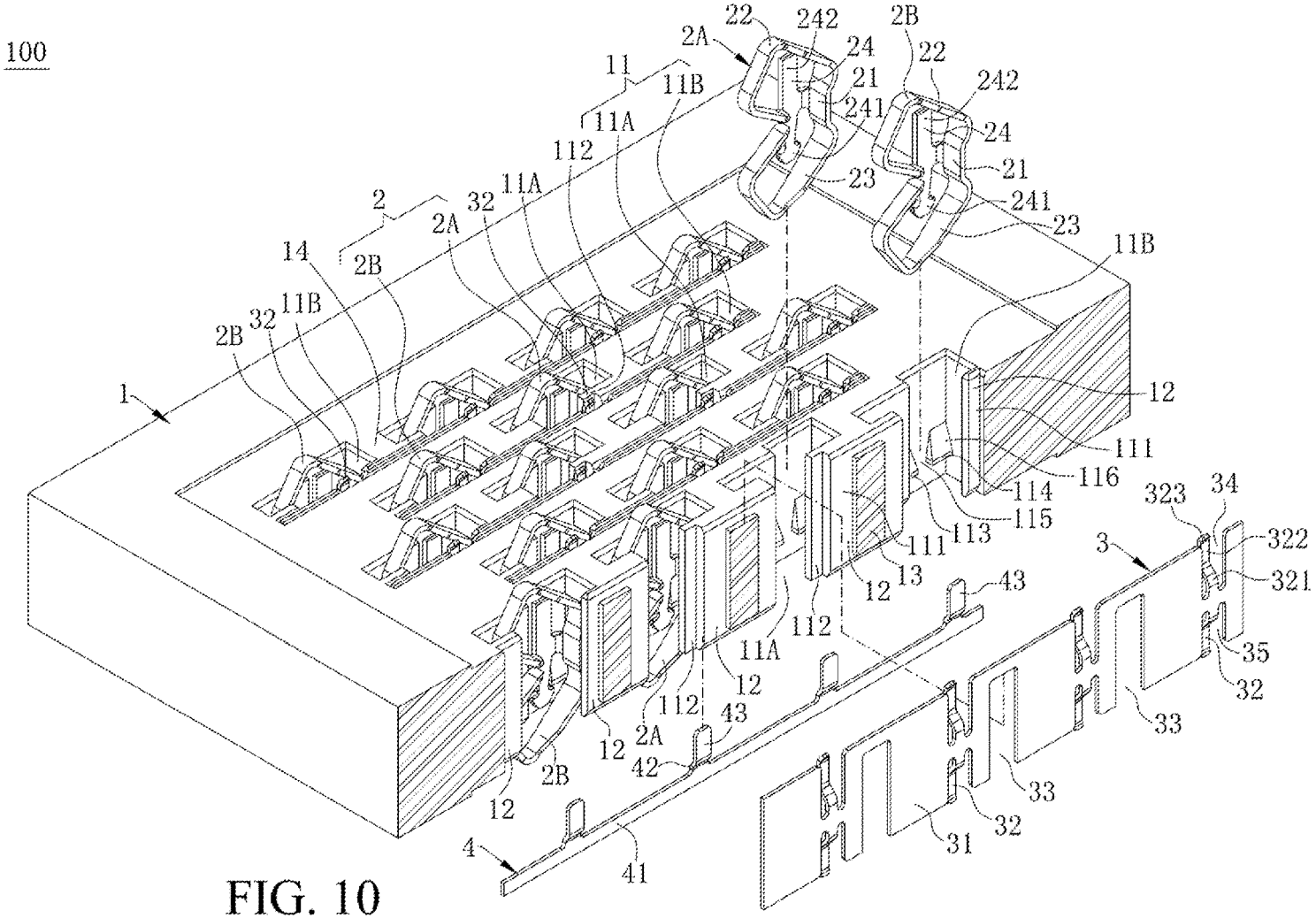
FIG. 10 is a three-dimensional exploded view of an electrical connector according to another embodiment of the present invention.
Figure 11:
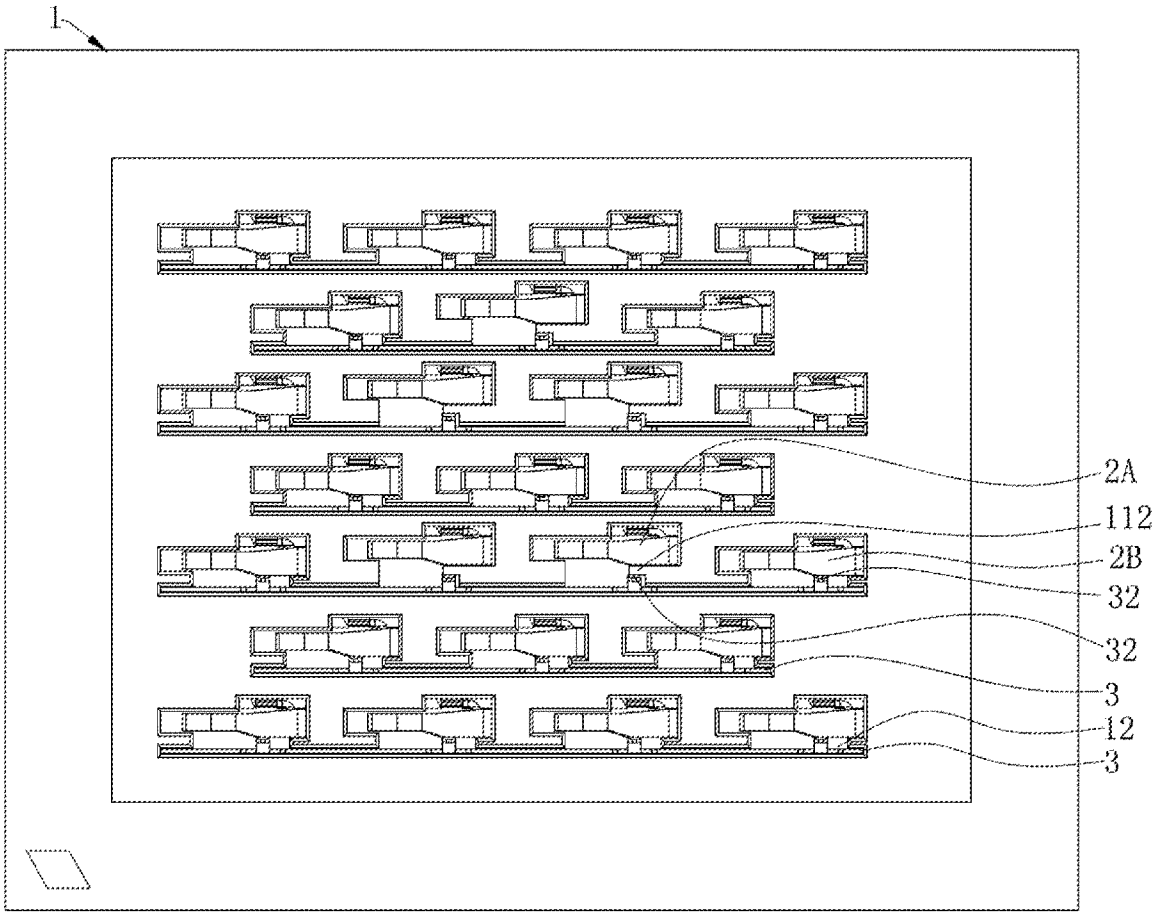
FIG. 11 is a top view of FIG. 10.

A electrical connector according to another embodiment of the present invention is shown in FIG. 10 and FIG. 11. The difference between this embodiment and the above-mentioned embodiment exists only in that the signal terminals 2A are farther away from the urging portions 32 than the ground terminals 2B, and the signal accommodating holes 11A are farther away from the urging portions 32 than the ground accommodating holes 11B, thus increasing the distance between the urging portions 32 and the signal terminals 2A, and avoiding the shielding sheets 3 from urging against the signal terminals 2A. The descriptions of other structures in this embodiment may be referred to in the corresponding descriptions of the above-mentioned embodiment, and the descriptions thereof are not elaborated herein.

To sum up, the electrical connector according to certain embodiments of the present invention has the following beneficial effects.

(1) Each shielding sheet 3 or each terminal 2 is provided with an urging portion 32, thus ensuring the ground terminals 2B to urge against the shielding sheets 3, and achieving a shielding effect between the signal terminals 2A. The stopping portions 112 stop the urging portions 32, thus avoiding the shielding sheets 3 from contacting with the signal terminals 2A, and preventing short circuiting of the signal terminals 2A.

(2) The urging portion 32 corresponding to each of the ground accommodating holes 11B urges against the upper elastic arm 22 or the lower elastic arm 23 of the corresponding ground terminal 2B. When the chip module 5 presses downward onto the upper elastic arm 22 or the lower elastic arm 23, the upper elastic arm 22 or the lower elastic arm 23 can be elastically deformed to move, such that the upper elastic arm 22 scrapes the plate surface of the corresponding shielding sheet 3, thereby removing an oxidation layer formed on the plate surface of the shielding sheet 3, enhancing an urging effect between the ground terminals 2B and the shielding sheets 3, and effectively preventing from an electromagnetic interference between conductive terminals.

(3) Each of the signal accommodating holes 11A and each of the ground accommodating holes 11B are respectively provided with at least one position limiting portion 111 located between the shielding sheets 3 and the upper elastic arm 22. The position limiting portions 111 are used for positioning the shielding sheets 3 into the signal accommodating holes 11A and the ground accommodating holes 11B, thus avoiding the upper elastic arms 22 from urging against the shielding sheets 3.

(4) When the chip module 5 presses downward onto the upper elastic arm 22, the upper elastic arm 22 urges against the lower elastic arm 23, so as to form a first conductive path passing through the chip module 5, the upper elastic arm 22, the connecting portion 21, the lower elastic arm 23 and the circuit board 6 in sequence, and a second conductive path passing through the chip module 5, the upper elastic arm 22, the lower elastic arm 23 and the circuit board 6 in sequence. Due to a parallel connection between the first conductive path and the second conductive path, the total impedance value is reduced, and the signal transmission performance is improved.

(5) The signal terminals 2A are farther away from the urging portions 32 than the corresponding ground terminals 2B, and the signal accommodating holes 11A are farther away from the urging portions 32 than the corresponding ground accommodating holes 11B, thus increasing the distance between the urging portions 32 and the corresponding signal terminals 2A, and avoiding the shielding sheets 3 from urging against the signal terminals 2A.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, provided with a plurality of accommodating holes penetrating through the insulating body vertically, the accommodating holes comprising signal accommodating holes and ground accommodating holes, wherein each of the signal accommodating holes is provided with a stopping portion;

a plurality of terminals, configured for contacting a chip module, and comprising signal terminals accommodated in the signal accommodating holes and ground terminals accommodated in the ground accommodating holes; and at least one shielding sheet, accommodated in the insulating body;

wherein the at least one shielding sheet or each of the terminals is provided with an urging portion, the ground terminals and the at least one shielding sheet contact each other through the urging portion, and the stopping portions stop the urging portion to prevent the signal terminals and the at least one shielding sheet from contacting each other.

2. The electrical connector of claim 1, wherein each of the signal terminals and each of the ground terminals are of a same structure and respectively provided with a connecting portion in a planar shape, and an upper elastic arm formed by bending and extending upward from the connecting portion, configured for conductively connected to the chip module.

3. The electrical connector of claim 2, wherein a plurality of urging portions are provided, and the urging portions are only provided on the at least one shielding sheet.

4. The electrical connector of claim 3, wherein the stopping portion of each of the signal accommodating holes is located between a corresponding one of the urging portions and the upper elastic arm of a corresponding one of the signal terminals, and the urging portion corresponding to each of the ground accommodating holes urges against the upper elastic arm of a corresponding one of the ground terminals.

5. The electrical connector of claim 3, wherein a lower elastic arm is formed by bending and extending downward from the connecting portion, configured for conductively connected downward to a circuit board; the stopping portion of each of the signal accommodating holes is located between a corresponding one of the urging portions and the lower elastic arm of a corresponding one of the signal terminals, and the urging portion corresponding to each of the ground accommodating holes urges against the lower elastic arm of the ground terminals.

6. The electrical connector of claim 3, wherein each of the signal terminals is farther away from the urging portions than each of the ground terminals.

7. The electrical connector of claim 3, wherein each of the signal accommodating holes is farther away from the urging portions than each of the ground accommodating holes.

8. The electrical connector of claim 2, wherein each of the signal accommodating holes and each of the ground accommodating holes are respectively provided with at least one position limiting portion located between the at least one shielding sheet and the upper elastic arm.

9. The electrical connector of claim 3, wherein the shielding sheet has a flat portion located at one side of an edge of the connecting portion, each of the urging portions is formed by bending and extending from the flat portion, and a plate surface of each of the urging portions urges against an edge of a corresponding one of the ground terminals.

10. The electrical connector of claim 9, wherein the upper elastic arm bends and extends from a top end of the connecting portion to one side of the flat portion, and then bends and extends to an opposite side of the flat portion.

11. The electrical connector of claim 9, wherein a retaining portion is formed by extending from a side of the connecting portion opposite to the shielding sheet to be retained to the insulating body.

12. The electrical connector of claim 11, wherein the retaining portion is parallel to a plate surface of the flat portion.

13. The electrical connector of claim 9, further comprising a metal sheet having a planar base located below the flat portion, wherein a bottom end of the flat portion contacts a top end of the base.

14. The electrical connector of claim 13, wherein a plurality of openings are concavely provided at the bottom end of the flat portion, an extending portion is formed by extending upward from the top end of the base to be accommodated in one of the openings, and a contact portion is formed by bending and extending upward from the extending portion to urge against a plate surface of the corresponding shielding sheet.

15. The electrical connector of claim 14, wherein each of the urging portions is formed by bending and extending downward from one of the openings, and the contact portion urges against the plate surface of a corresponding one of the urging portions.

16. The electrical connector of claim 15, wherein a protruding portion is protrudingly provided on a plate surface of the contact portion to urge against the plate surface of a corresponding one of the urging portions.

17. The electrical connector of claim 9, wherein a notch is concavely provided at a top end of the flat portion, each of the urging portions is formed by bending and extending upward from the notch, and the plate surface of each of the urging portions urges against an edge of the upper elastic arm of a corresponding one of the ground terminals.

18. The electrical connector of claim 17, wherein each of the urging portions has a connecting section formed by bending and extending from the notch toward the edge of the upper elastic arm, and an urging section formed by vertically extending upward from the connecting section, wherein a free end is formed by bending and extending from the urging section to be away from the edge of the upper elastic arm, and a plate surface of the urging section urges against the edge of the upper elastic arm.

19. The electrical connector of claim 1, wherein the at least one shielding sheet corresponds to a row of the terminals, the insulating body is provided with an accommodating groove for accommodating the at least one shielding sheet, and the accommodating groove is communicated with the signal accommodating holes and the ground accommodating holes.

20. The electrical connector of claim 1, wherein the shielding sheet is provided with a plurality of through slots, the insulating body is provided with a plurality of positioning portions accommodated in the through slots respectively, a partitioning wall is provided between each of two adjacent ones of the accommodating holes, and the partitioning wall and the positioning portions are arranged abreast.

* * * * *